United States Patent [19]

Di Bernardo

[11] Patent Number: 4,928,829

[45] Date of Patent: May 29, 1990

[54] DEVICE FOR TIGHTLY SEALING BAGS DESTINED TO THE VACUUM PACKAGING OF VARIOUS PRODUCTS, IN PARTICULAR FOODSTUFFS

[75] Inventor: Pietro Di Bernardo, Milan, Italy

[73] Assignee: Interdibipack S.p.A., Mazzo Di Rho, Italy

[21] Appl. No.: 298,167

[22] Filed: Jan. 18, 1989

[30] Foreign Application Priority Data

Jan. 22, 1988 [IT] Italy ..... 19170 A/88

[51] Int. Cl.[5] ..... B65B 31/06; B65D 33/17

[52] U.S. Cl. ..... 206/524.8; 53/434; 53/512; 383/68

[58] Field of Search ..... 53/86, 79, 138 A, 371, 53/387, 393, 417, 479, 434, 512; 206/524.8; 383/68

[56] References Cited

U.S. PATENT DOCUMENTS

| | | | |
|---|---|---|---|
| 3,851,437 | 12/1974 | Waldrop et al. | 53/434 |
| 3,866,390 | 2/1975 | Moreland, II et al. | 53/512 X |
| 3,939,287 | 2/1976 | Orwig et al. | 53/512 X |
| 3,965,646 | 6/1976 | Hawkins | 53/512 |
| 4,164,111 | 8/1979 | Bernardo | 53/512 X |
| 4,174,599 | 11/1979 | Callet et al. | 53/512 |
| 4,221,101 | 9/1980 | Woods | 53/79 |
| 4,241,558 | 12/1980 | Gidewall et al. | 53/512 X |
| 4,330,975 | 5/1982 | Kakiuchi | 53/512 X |
| 4,478,025 | 10/1984 | Scanlan | 53/512 |

*Primary Examiner*—J. Sipos
*Assistant Examiner*—Beth Bianca
*Attorney, Agent, or Firm*—Charles E. Brown; Charles A. Brown

[57] ABSTRACT

A device for tightly sealing bags and/or envelopes destined to the vacuum packaging of products, in particular foodstuffs, comprising a clamping member equipped with means for grasping and tightly closing against each other mutually opposite edges in correspondence of the open side of said bag. With the grasping and clamping means, a valve element cooperates, through which the air contained inside the bag can be evacuated when to the bag a vacuum source is applied.

5 Claims, 4 Drawing Sheets

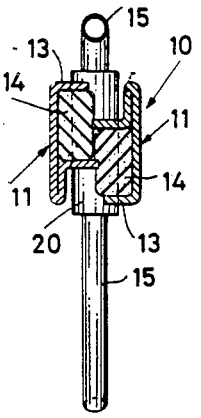
Fig.3
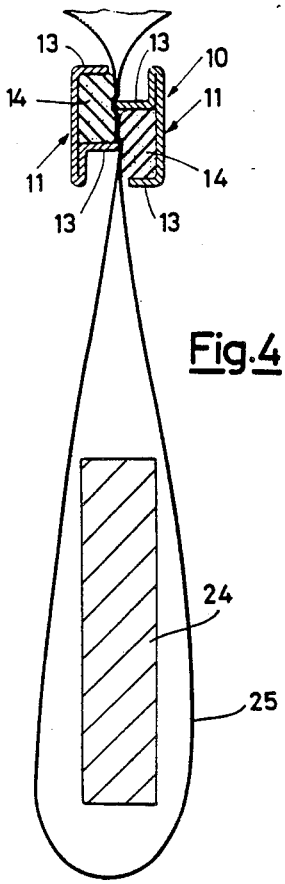
Fig.4
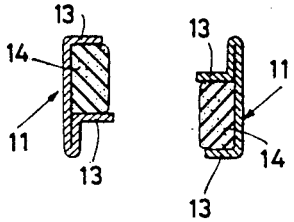
Fig.5
Fig.6
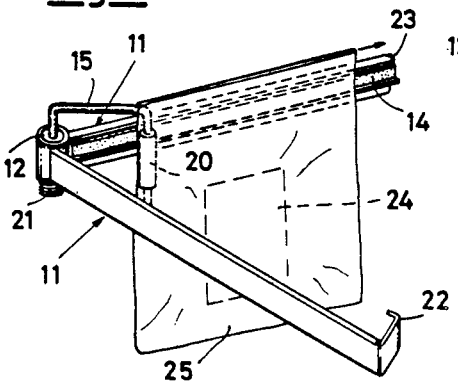
Fig.7
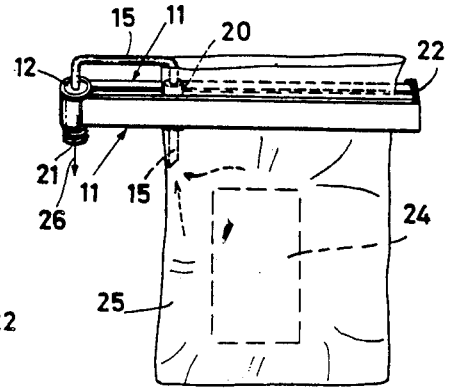

DEVICE FOR TIGHTLY SEALING BAGS DESTINED TO THE VACUUM PACKAGING OF VARIOUS PRODUCTS, IN PARTICULAR FOODSTUFFS

BACKGROUND OF THE INVENTION

The present invention is concerned with a device for tightly sealing bags and/or envelopes destined to the vacuum packaging of various products, in particular, but to limitedly to, foodstuffs.

For that purpose, the use is known of vacuum chambers which incorporate means for welding and clipping the envelope, as well as suction device in order to generate vacuum inside the envelope through valves incorporated in the same envelope.

However, all such systems are relatively expensive, in that they require the use of welding and clipping means, or of disposable envelopes incorporating a valve.

SUMMARY OF THE INVENTION

The general purpose of the present invention is obviate the limitations which affect the prior art by providing a device by means of which it is possible to obtain in a simple, fast and extremely cheap way, vacuum packages of products packaged inside an envelope.

Such a purpose is achieved according to the present invention by means of a device for tightly sealing bags destined to the vacuum packaging of products, characterized in that it comprises, in combination: a clamping member provided with means for grasping and tightly closing against each other mutually opposite edges in correspondence of the open side of the bag. A valve element cooperates with the grasping means in order to evacuate the air contained inside the bag when a vacuum source is applied to the same bag. The grasping means are preferably constituted by a clamp with a pair of mutually opposite, rod-shaped jaws provided with sealing gaskets. The jaws are pivotally hinged to each other in correspondence of one of their ends, and are provided with locking means in correspondence of their opposite end.

Preferably, the valve element is a single-acting valve.

Preferably, the single-acting valve is provided with means of connection with a sucking pump.

As an alternative, the vacuum source is a vacuum bell.

The structural and functional characteristics of the present invention and its advantages over the prior art are more clearly evident from an examination of the following disclosure made by referring to the hereto attached schematic drawings, which depict an exemplifying form of practical embodiment of the invention.

BRIEF DESCRIPTION OF THE DRAWING

In the drawings:

FIG. 3 shows a sectional view made according to the plane represented by path III—III of FIG. 1;

FIG. 4 shows a sectional view made according to the plane represented by path IV—IV of FIG. 1;

FIG. 5 shows a sectional view illustrating the clamp of the device in its open condition;

FIGS. 6 and 7 show two perspective views illustrating the application of a bag to the clamp;

DESCRIPTION OF THE PREFERRED EMBODIMENT

Figure 1:
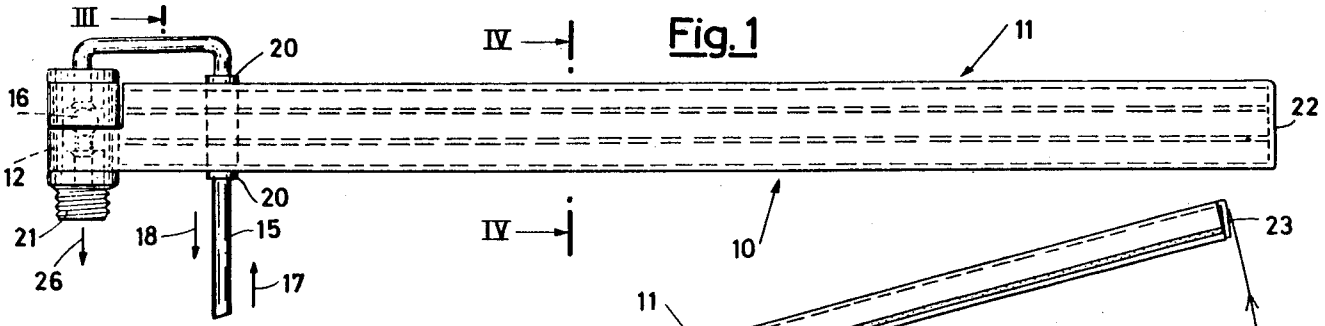
FIG. 1 shows an elevation view illustrating the device according to the present invention.

Referring to the drawings, the device according to the present invention is structurally formed by a clamping member, such as, e.g., a clamp 10 comprising a pair of rod-shaped jaws 11, which are pivotally hinged to each other in correspondence of one of their ends by means of a pivot 12. The jaws 11 can be made, e.g., by bending a sheet of stainless steel, so as to obtain essentially "U"-shaped structural shapes with mutually opposite flanges 13 (FIGS. 3–5).

As one will clearly see from the drawings, between the mutually opposite flanges 13 of each jaw 11 a gasket 14 made from a yielding material, such as, e.g., rubber, is housed and fastened.

Figure 2:
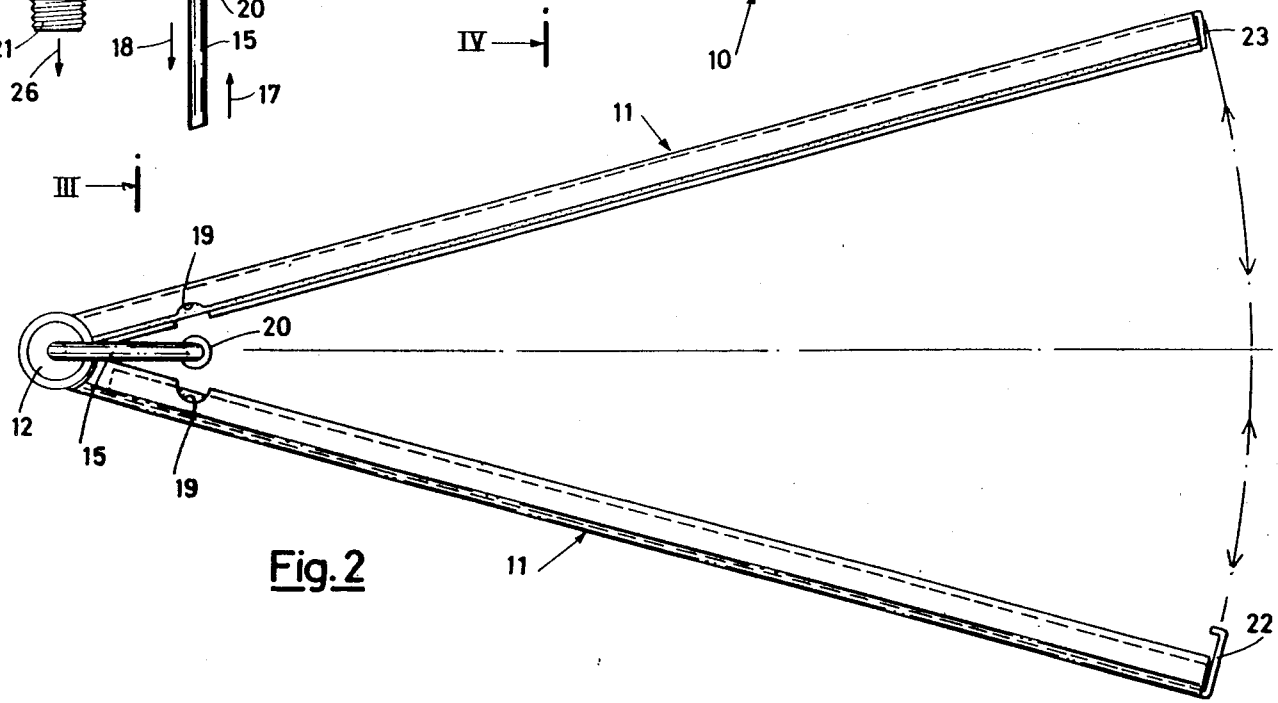
FIG. 2 shows a plan view.

The clamp 10 furthermore comprises an air-suction pipe 15 which incorporates a nonreturn valve, e.g., a ball valve 16, which allows an air stream to flow in the direction of the arrow 17, but not in the direction of the arrow 18. The nonreturn valve 16 is incorporated inside the pivot 12, from which the pipe 15 extends. The pipe 15 is bent to an essentially "U"-like shape, so as to pass through the jaws 11 of the clamp 10, as shown in FIGS. 1 and 2.

For that purpose, the mutually opposite jaws 11 are provided with semicircular hollows 19 and in correspondence of the hollows, around the pipe 15 a rubber sleeve 20 is applied; in order to generate the tight sealing, the rubber sleeve 20 cooperates with the walls of the bag inside which vacuum is to be made, as it is explained in the following.

Downstream of the valve 16, the pivot 12 is furthermore provided with a screw-threaded fitting 21 for an air-suction pipe, not shown in the Figures.

The clamp 10, at its end opposite to the pivot 12, is finally provided with a snap-lock, which can be constituted, e.g., by a hooking element 22 provided on a jaw 11 and cooperating with the end, which is purposely given an invitation shape 23, provided on the other jaw.

The above disclosed device operates as follows.

Referring to the drawings, a product 24 which one wishes to vacuum-package—e.g., am alimentary product—is charged to a bag of plastic material 25 essentially having an envelope-like shape with an open side. The envelopes are commonly found on the market with dimensions variable within very wide ranges.

As FIGS. 6 and 7 of the attached drawings clearly show, an envelope 25 which contains a product 24 is placed with an edge thereof in correspondence of its open side between the jaws 11 of the clamp 10, with the operator being careful of inserting inside the same envelope the suction pipe 15, after which the clamp 10 can be tightened in the position shown in FIGS. 4 and 7, so as to achieve a tight sealing of the envelope 25.

The envelope 25 provided with the clamp 10 can be connected to a vacuum source, schematically shown by the arrow 26.

The vacuum source can be constituted either by a traditional vacuum "bell", or by a pump , the intake duct of which is connected with the screw-threaded fitting 21 of the pipe 15.

In this way, it clearly appears that the air contained inside the envelope 25 can be evacuated within very short times, through the suction pipe 15, after which the envelope 25, equipped with the clamp 10, can be disconnected from the vacuum source.

The vacuum so obtained inside the envelope 25 is preserved thanks to the presence of the nonreturn valve 16 and to the tight-sealing gaskets 14; thus, the envelope can be stored inside an environment suitable for the vacuum preservation of its contents, e.g., a refrigerator cabinet in case of foodstuffs.

According to a further form of practical embodiment of the present invention, the assembly constituted by the suction pipe 15 and the valve 16 can be movable, so as to make it possible the pipe 15 to be slid off, with a rapid action, from the envelope 25 and from the clamp 10, so that the tight-sealing gaskets 14 may come to perfectly rest against each other, thus eliminating areas of possible leaks as extensively as possible. For that purpose, the sleeve 20 may be given a tapered shape, e.g. an olive-like shape.

Furthermore, in order to improve—if necessary—the sealing action of the gaskets 14, the jaws 11 can extend beyond the pivot 12, so as to define a pair of mutually opposite elements for manual grasping, between which a contrast spring is provided, which acts so as to close the jaws 11 against each other.

By means of the device according to the present invention, it is also possible to weld the envelope, along a line under the clamp, with a separate welding equipment, after which the clamp can be recovered, and the envelope can be stored wherever desired. This is advantageous when a large number of envelopes have to be stored for long time periods, which would require an expensive immobilization of an as large number of clamps.

A device for the tight sealing of bags destined to the vacuum packaging of products is thus provided. The cost of which is very low. The clamp 10, as well as the same envelope can be used again. Furthermore, the envelope seal does not require expensive welding or clipping operations.

The system is therefore particularly suitable for use in families, communities, shops, and anyway whenever the need arises of vacuum packaging, with a low cost, various kinds of products, in particular foodstuffs.

Figure 8:
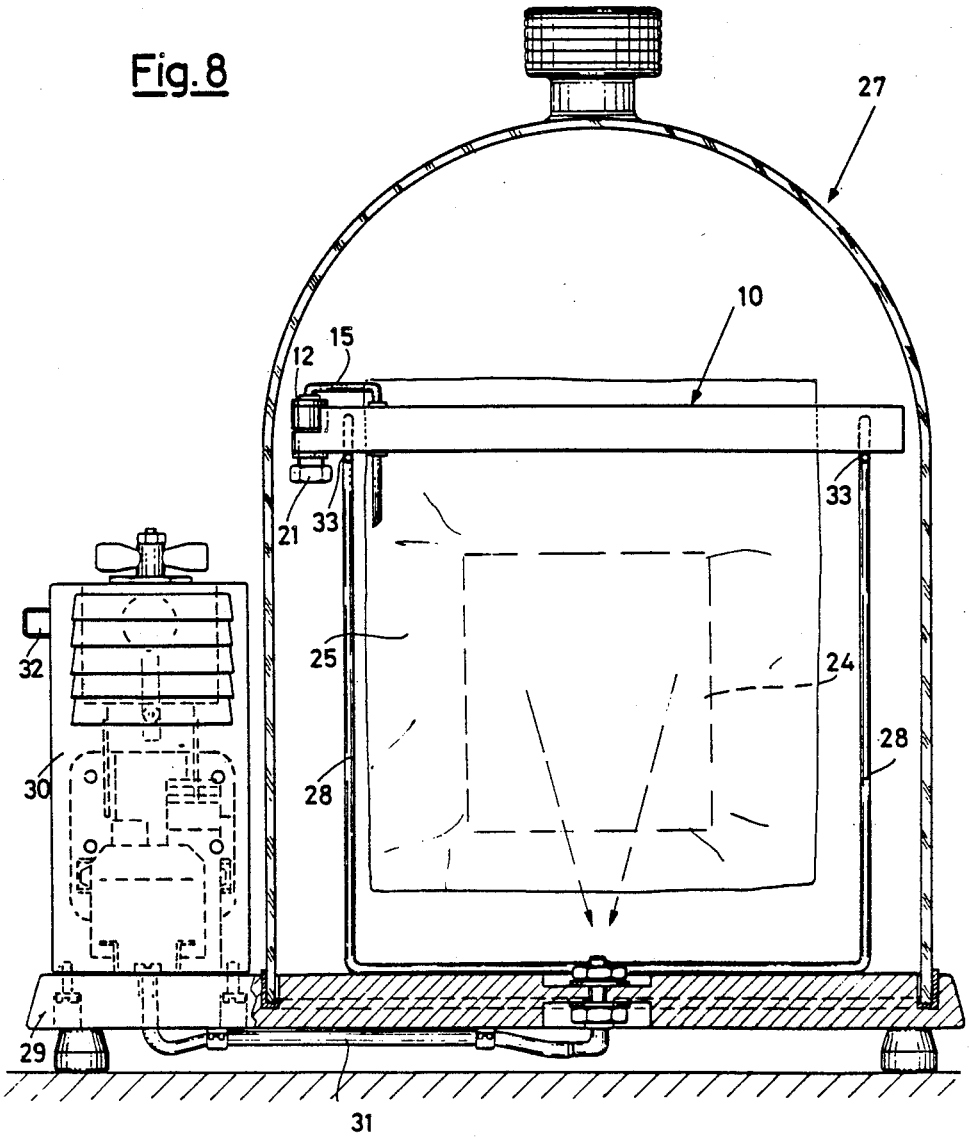
FIG. 8 shows a vertical sectional view of a vacuum bell which can be used with the device of the invention.
Figure 9:
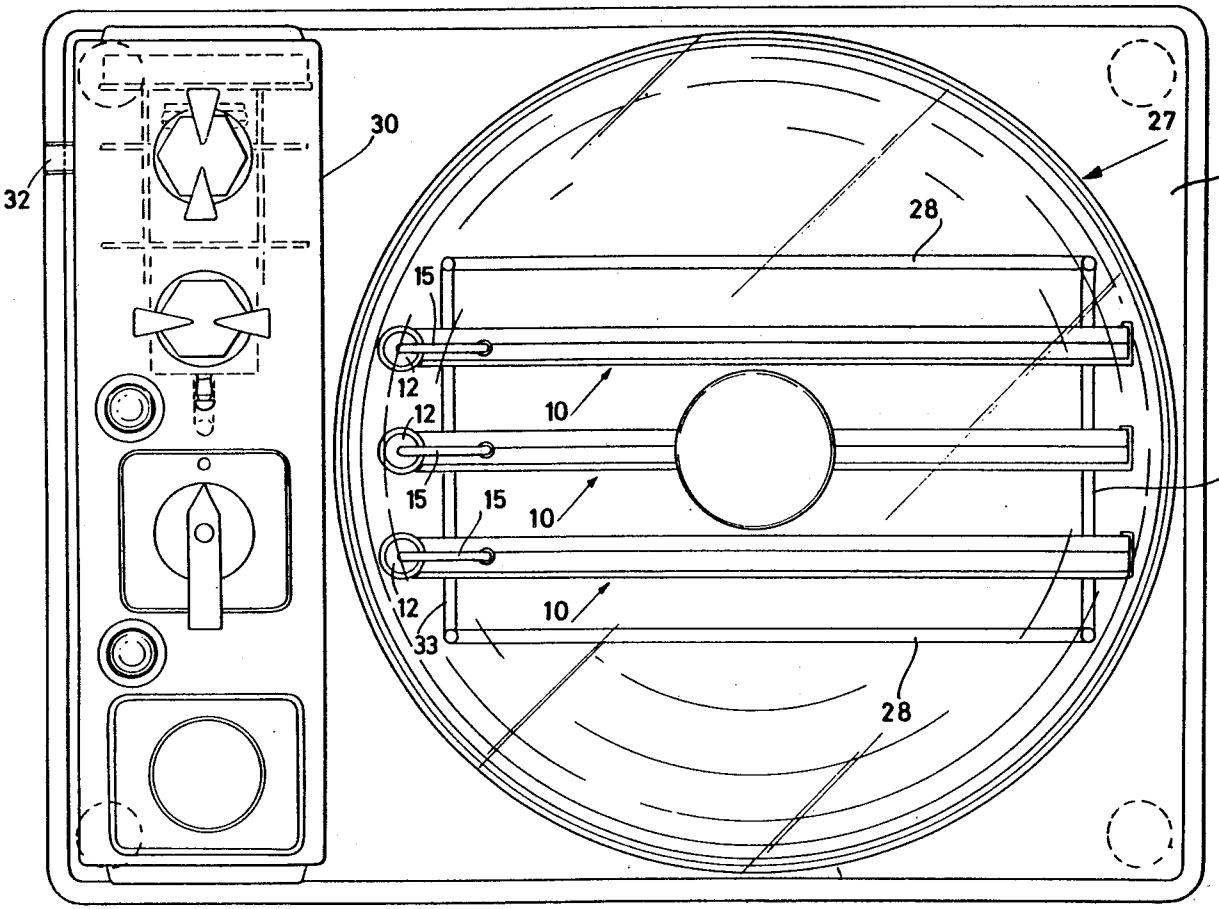
FIG. 9 shows a plan view of the bell of FIG. 8.

It should be observed that a plurality of envelopes sealed as shown in FIG. 7 of the drawings can be charged to one single vacuum bell 27, as shown in FIGS. 8 and 9 of the drawings, so as to simultaneously achieve a plurality of packages. For that end, inside the bell 27 a bracket support 28 can be provided, which is suitable for bearing a plurality of envelopes—in the herein shown example, three envelopes—by simply leaning the relevant clamps on bars 33 provided at the top of the support 28.

The bell 27 is placed, with tight sealing, on a base 29 which also laterally bears a vacuum pump 30 of a per se known type, herein not disclosed in greater detail.

The intake end of the pump 30 is connected with the interior of the bell 27 by means of a duct 31, and the same pump 30 is provided with a fitting 32 with which the screw-threaded fitting 21 can be connected through an auxiliary duct, in order to generate vacuum inside a single envelope outside the bell 27.

The base 29, without the bell 27, can be used as a comfortable working plane, e.g., as a "trencher".

Furthermore, one should observe that the system according to the present invention is not very cumbersome, in that both the vacuum pump and the vacuum bell can be comfortably placed on shelves or pieces of furniture of a normal kitchen.

I claim:

1. A clamping mechanism for tightly sealing a bag and for vacuum packing of product within the bag without any other seal, the bag having an open side with a pair of mutually opposed edges, said clamping mechanism comprising a clamping member and a valve element cooperating with each other to evacuate air contained inside the bag containing the product when said valve element is connected a source of vacuum in order to produce the vacuum packaging of the product, said clamping member having means for grasping and tightly closing the mutually opposed edges of the bag against each other whereby the open side of the bag is sealed closed, said valve element having a connection duct which extends through said grasping and tightly closing means and is insertable into the interior of the bag.

wherein said grasping and tightly closing means are a pair of mutually opposed rod-shaped jaws pivoted together at one end on a pivot with said valve mounted at said pivot.

2. The clamping mechanism according to claim 1, wherein said jaws are provided with sealing gaskets, each jaw has a pair of opposed ends, said jaws are pivotably hinged to each other at one of their ends, the other end of each jaw is provided with locking means for retaining the non-pivoted ends in a closed position whereby sealing of the open side of the bag results.

3. The clamping mechanism according to claim 1, wherein said valve element is a single-acting valve.

4. The clamping mechanism according to claim 1, wherein the vacuum source is a suction pump which is connected to said valve element.

5. The clamping mechanism according to claim 1, wherein the vacuum source is a vacuum bell connected to said valve element.

* * * * *